US008205394B1

(12) United States Patent
Jackman et al.

(10) Patent No.: US 8,205,394 B1
(45) Date of Patent: Jun. 26, 2012

(54) ADJUSTABLE BATHTUB LEDGER STRAP AND METHOD OF USE

(76) Inventors: John D. Jackman, Framingham, MA (US); Christopher M. Jackman, Framingham, MA (US)

( * ) Notice: Subject to any disclaimer, the term of this patent is extended or adjusted under 35 U.S.C. 154(b) by 170 days.

(21) Appl. No.: 12/803,961

(22) Filed: Jul. 12, 2010

(51) Int. Cl.
*A47K 3/16* (2006.01)

(52) U.S. Cl. ..... 52/35; 52/741.1; 4/592; 4/595

(58) Field of Classification Search ..... 52/34, 35, 52/92.2, 289, 702, 712, 741.1; 4/592–595
See application file for complete search history.

(56) References Cited

U.S. PATENT DOCUMENTS 1,962,784 A * 6/1934 Nelson ..... 4/595
1,999,467 A * 4/1935 Lucke ..... 4/595
4,879,858 A * 11/1989 Murdoch ..... 52/741.4
6,131,361 A * 10/2000 Murphy ..... 52/712
2006/0196143 A1* 9/2006 Roesset et al. ..... 52/712
2009/0056268 A1* 3/2009 Greenlee et al. ..... 52/702

* cited by examiner

*Primary Examiner* — Brian Glessner
*Assistant Examiner* — Brian D Mattei
(74) *Attorney, Agent, or Firm* — William Nitkin

(57) ABSTRACT

A bathtub ledger strap for use with the installation of a bathtub, such ledger strap being of generally planar construction for attachment to a ledger stud in a position corresponding to a wall stud, such ledger strap having a top portion, a mid portion and a lower portion disposed along its length with such portions having apertures/slots for adjusting the height and level of the ledger stud on a corresponding wall stud using screws and levering means and for permanently attaching the rim of the bathtub to the ledger strap and corresponding wall stud after the ledger stud is at the desired height and level state.

12 Claims, 5 Drawing Sheets

ADJUSTABLE BATHTUB LEDGER STRAP AND METHOD OF USE

BACKGROUND OF THE INVENTION

1. Field of the Invention

The device and method of this invention reside in the field of adjustable brackets to support a bathtub ledger stud and more particularly relate to a metal ledger strap having means for adjusting the height and level of a bathtub ledger stud and its method of use.

2. History of the Prior Art

It has long been appreciated that bathtubs must be installed level and at a desired height to have proper bathtub water drainage and to assure that tile surrounding the bathtub can be properly installed in level rows. However, such bathtub installation can be very difficult to accomplish since bathtubs can be quite heavy and cumbersome to move around. Furthermore, should a bathtub be installed out of level, many problems can arise in later construction around the bathtub. To this end brackets have been devised for use to support bathtubs, such as taught in U.S. Pat. No. 1,938,818 to Erickson for a Bathtub Supporting Bracket; U.S. Pat. No. 2,102,920 to Lucke for a Bathtub Hanger; U.S. Pat. No. 2,017,710 to Clark for a Tub Bracket; and U.S. Pat. No. 2,602,936 to Erickson for a Bathtub Supporting Bracket. The prior art brackets can sometimes be very difficult to use since the installation of the brackets at a specific height must be done before the bathtub is positioned in place. Such brackets are usually screwed to their final position on the wall studs and the bathtub is then placed on the brackets. Some brackets include means for attempting height adjustment, such as screw members which are rotated to different heights under the bathtub rim, but these screw members can often be difficult to reach. Such adjustable bathtub support systems are taught in U.S. Pat. No. 5,915,850 to Krist for a Support System for Bath, Shower or Whirlpool Tubs and U.S. Pat. No. 5,960,489 to Hanel for a Support System for Bath or Shower Tubs.

SUMMARY OF THE INVENTION

It is an object of this invention to provide a bathtub mounting system utilizing at least two adjustable ledger straps and their method of use. In a preferred embodiment three of the adjustable ledger straps of this invention are positioned, respectively, on three different wall studs that are disposed behind the bathtub. Each adjustable ledger strap of this invention to be used is first attached to the bathtub ledger stud and then to its corresponding wall stud in a temporary position where the bathtub ledger stud is to be installed. Once the height of the ledger straps have been adjusted, they are fixed in their final positions; and the bathtub and wall can then be installed.

It is a further object of this invention to provide means for ledger strap adjustment to various heights when each ledger strap is in position attached to its respective wall stud including even when a bathtub is in position resting on the ledger stud held in place by the ledger straps.

The ledger strap of this invention consists of an elongated planar strip of strong metal having an upper portion, a mid portion and a lower portion. The upper portion is separated from the mid portion by a plurality of upper perforations disposed perpendicularly to the length of the elongated ledger straps, and the bottom portion is separated from the mid portion by a plurality of lower perforations disposed perpendicularly to the length of the elongated ledger strap. The plurality of upper perforations allow the upper portion, being referred herein as the top lift tab, to be bent downward toward the front face of the ledger strap; and the lower perforations allow the bottom portion, herein referred to as the bottom ledger stud engagement portion, to be also bent upward toward the front face of the ledger strap, as described further below.

It is a still further object of this invention to enable a single individual to install a bathtub at a desired height and level. Prior to using the ledger strap of this invention, one first marks the positioning of at least two and preferably three wall studs along the length of the ledger stud to be used, choosing a wall stud near each end of the ledger stud and preferably also one near its midpoint. One then takes each ledger strap and bends the lower ledger stud support along the lower perforations upward approximately 90 degrees so that each ledger strap forms an L shape. One can then bend the top lift tabs of each ledger strap downward approximately 30 degrees along the upper perforations and its use will be described further below. Each ledger strap has a plurality of apertures formed therein, such as lift slots defined in the upper portion; side ledger stud engagement apertures, tightening screw slot, tub attachment slot and four attachment apertures, in the mid portion; and the bottom ledger stud engagement apertures, in the lower portion. One can then attach each ledger strap to the ledger stud with screws passing through the side ledger stud engagement apertures and through the bottom ledger stud engagement apertures so that the three ledger straps are securely attached to the ledger stud at positions corresponding to the locations of the selected wall studs. One then maneuvers the ledger stud into a position where it is close to its desired height with the ledger straps aligned parallel to one another extending upwards from the ledger stud and substantially perpendicular thereto and with each ledger strap disposed in front of its respective wall stud. Defined lengthwise in the mid portion of each ledger strap are two slots being a tightening screw slot and a tub attachment slot with the tub attachment slot positioned below the tightening screw slot. Positioned below the tub attachment slot of each ledger strap are side ledger stud engagement apertures. One then positions a pan head screw through the tightening screw slot of each ledger strap and screws it into its respective wall stud to engage and hold each ledger strap in place to support the ledger stud perpendicular to the vertical wall studs. One can then apply a level to the ledger stud and maneuver it to its approximate level state. At this point to accomplish the leveling of the ledger stud the pan screw in its tightening screw slot can be slightly loosened and an awl can be inserted into a selected lift slot defined in the upper portion to maneuver by a lever action each ledger strap either upwards or downwards. Further, by grasping the forwardly extending top lift tab of each ledger strap, one can pull it upwards or push it downwards until the desired height and level state of the ledger strap are achieved. At the desired height one can tighten each pan head screw in the tightening screw slot. One then inserts wood screws into the first, second, third and fourth attachment apertures in the midportion of each ledger strap to securely and permanently hold the ledger straps in position at their desired height. One then bends the top lift tab of each ledger strap backwards and forwards along the upper perforations until they break off the ledger straps. The pan head screws can then be removed so that their heads will not protrude into the plaster board to be placed over the ledger straps attached to the wall studs. One can then continue to install the bathtub with its rim resting on top of the ledger stud by screwing in a tub attachment screw driven into the rim of the bathtub, through the tub attachment slot and into wall stud therebehind and then build the walls around the bathtub.

DESCRIPTION OF THE PREFERRED EMBODIMENT(S)

Figure 1:
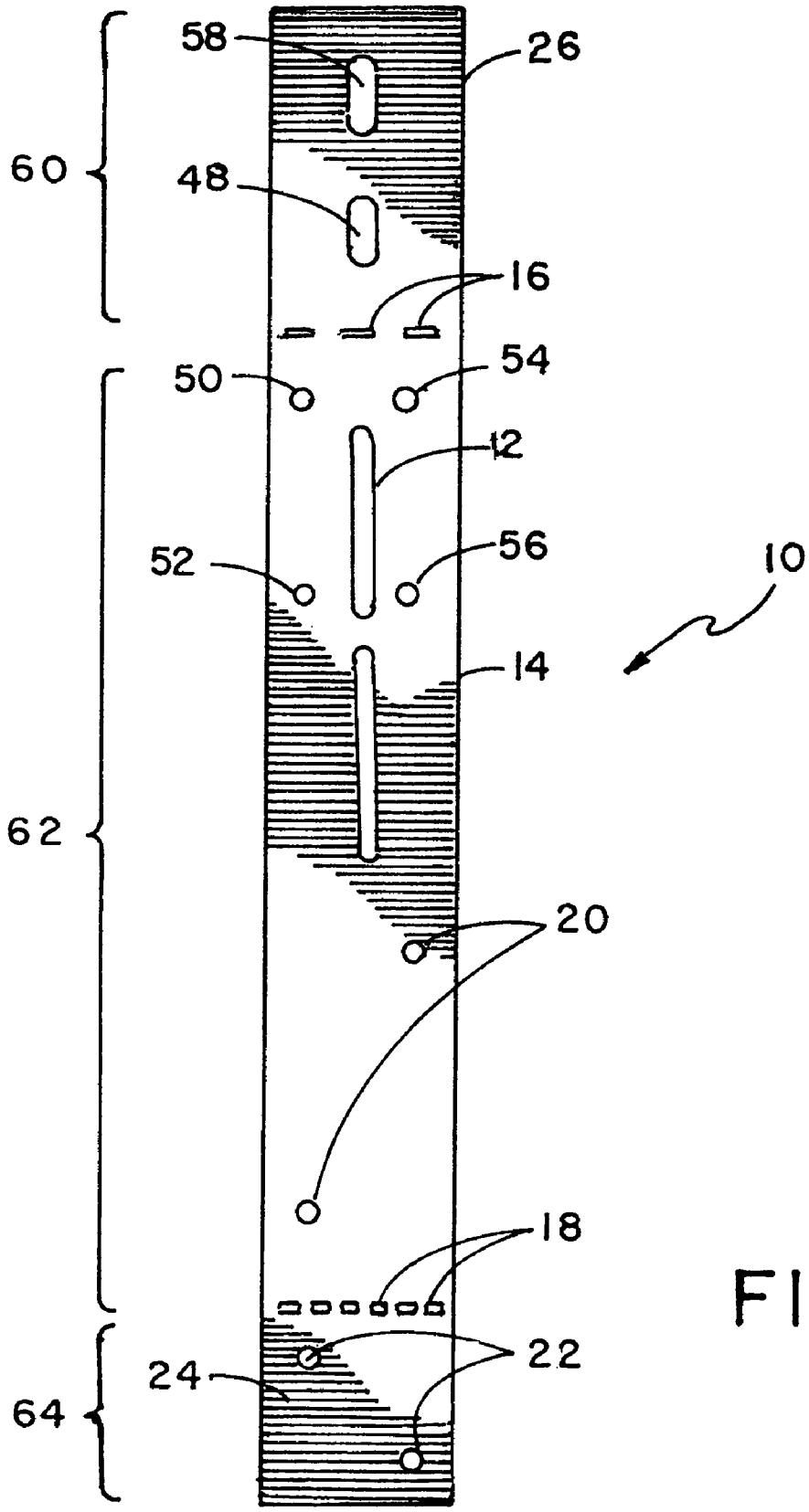
FIG. 1 illustrates a front elevational view of the adjustable ledger strap of this invention in its planar state.
Figure 2:
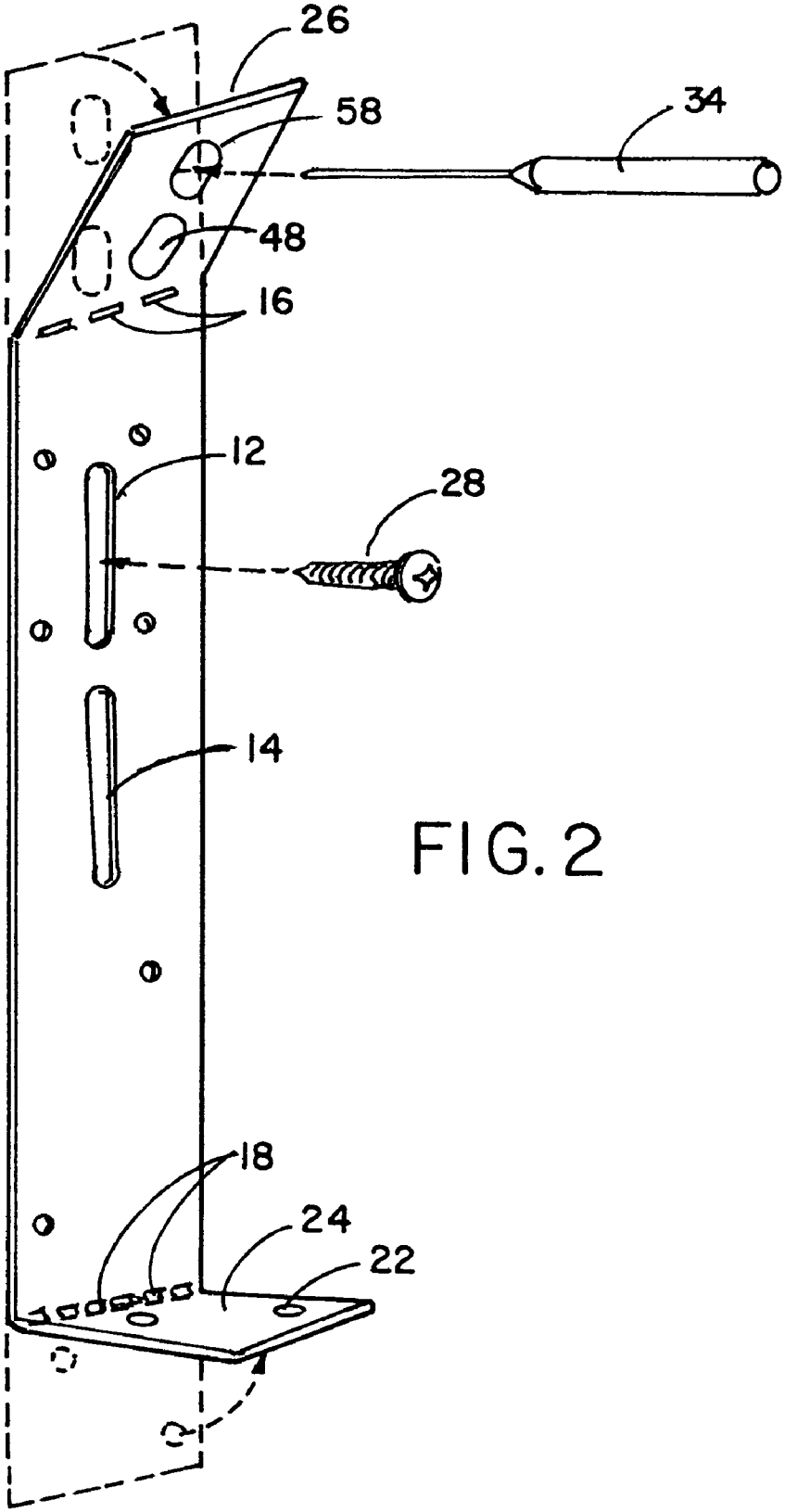
FIG. 2 illustrates a perspective view of the adjustable ledger strap showing the lower ledger stud support bent upwards approximately 90 degrees and showing the top lift tab bent downwards approximately 30 degrees.
Figure 3:
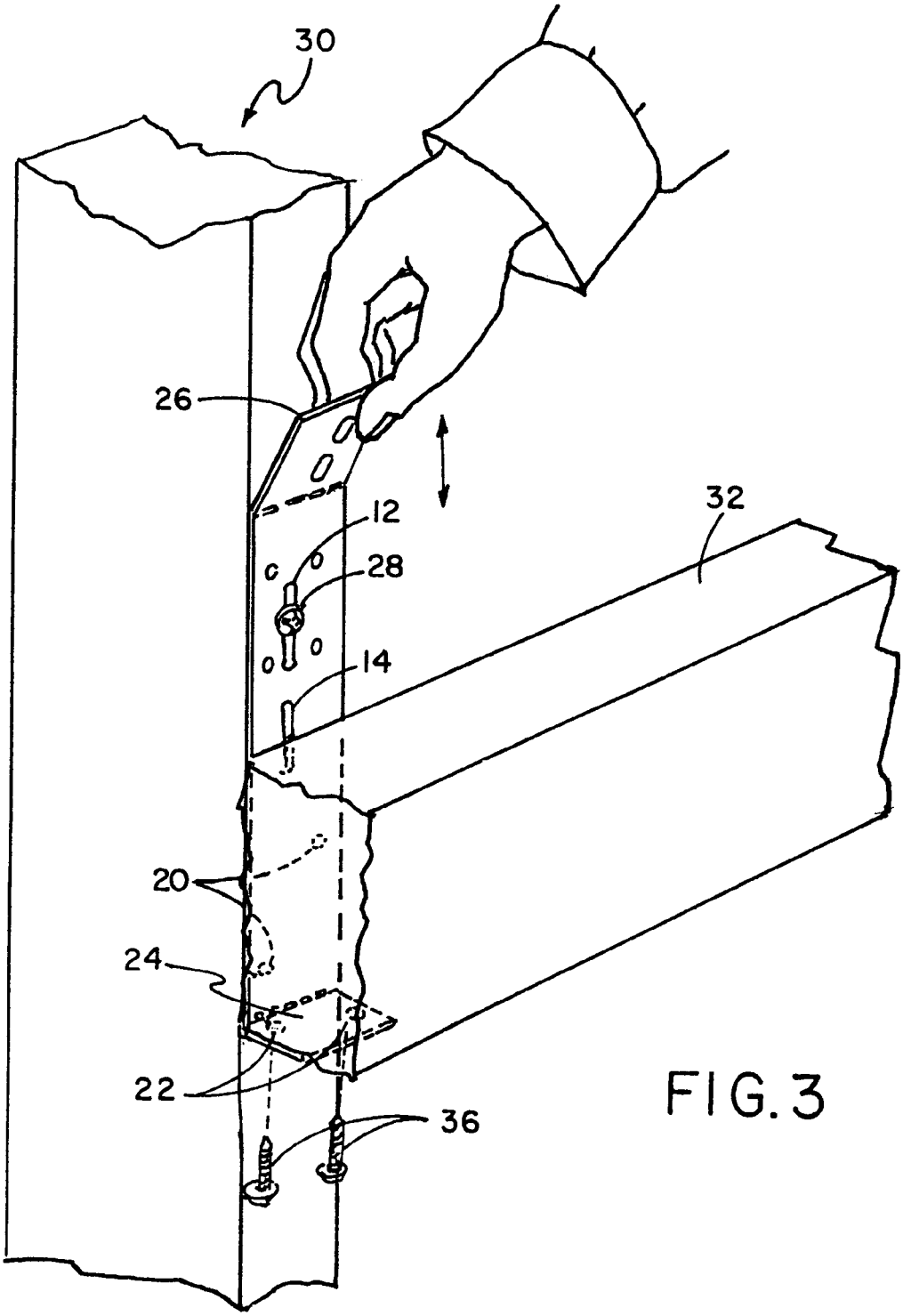
FIG. 3 illustrates a perspective view of the adjustable ledger strap of this invention attached to both a ledger stud and a wall stud and showing the top lift tab being manually adjusted either upwards or downwards.
Figure 4:
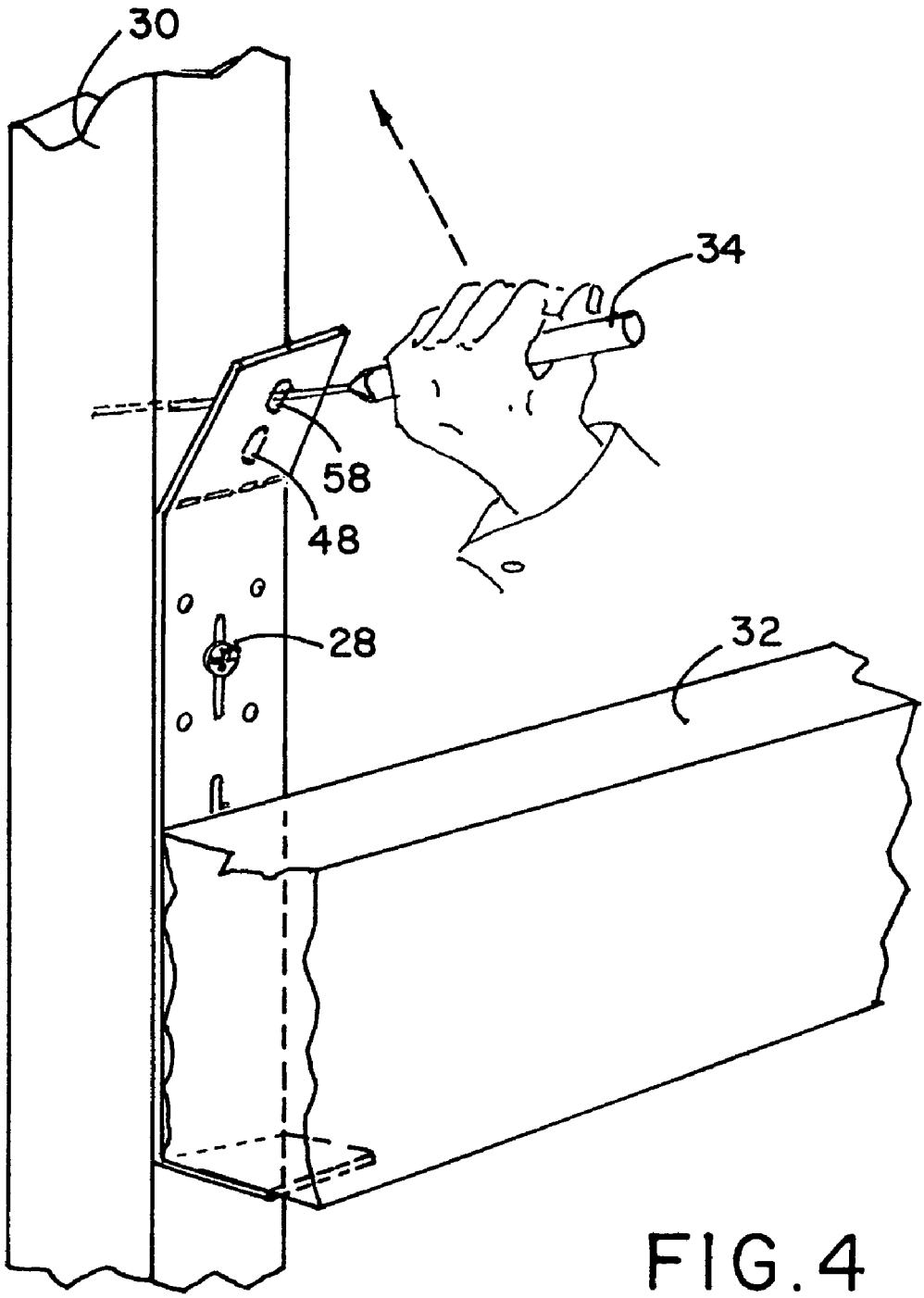
FIG. 4 illustrates a perspective view showing the lifting of an adjustable ledger strap by manually inserting an awl within the second lift slot to lift the ledger stud to a desired height.
Figure 5:
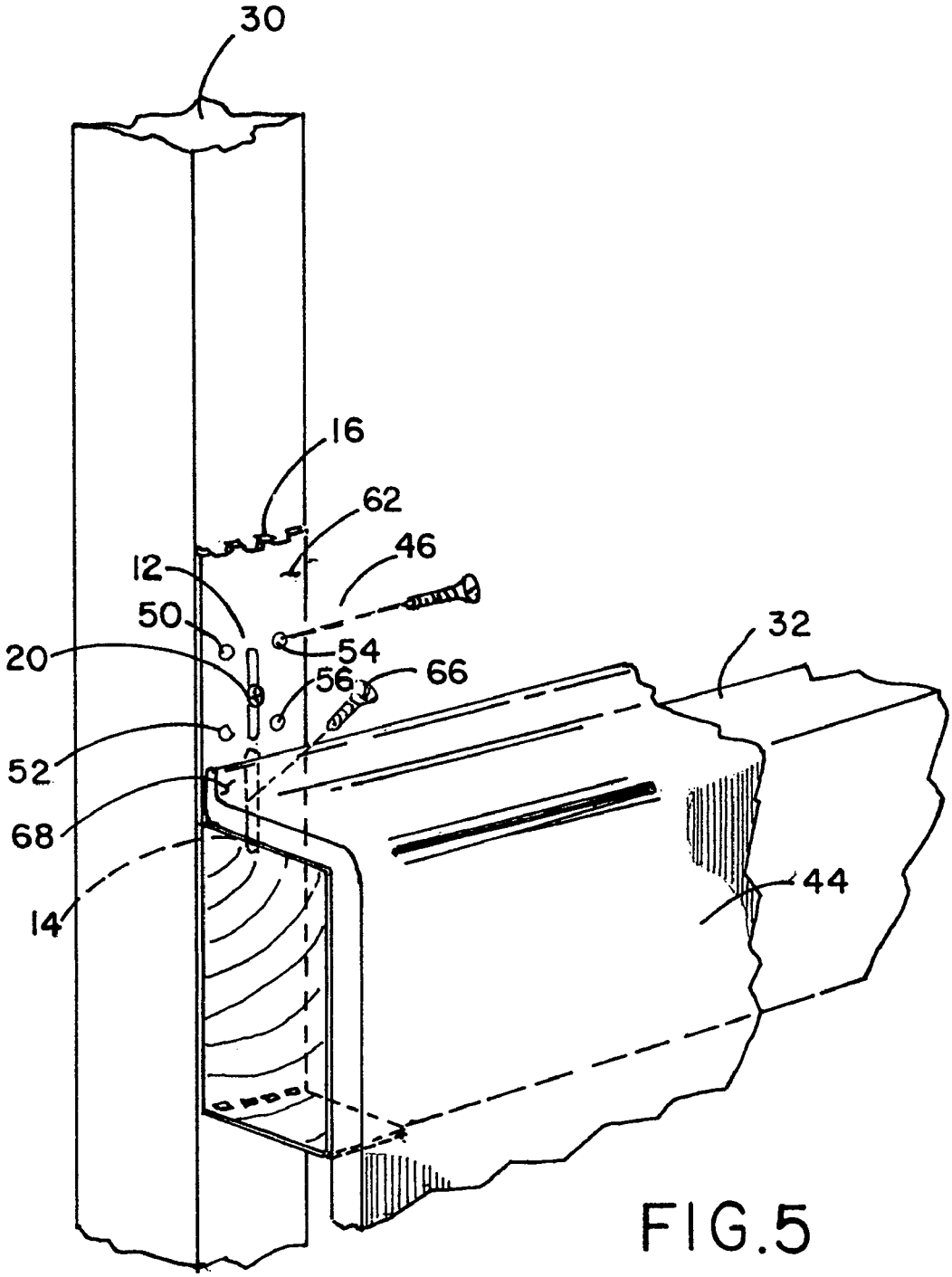
FIG. 5 illustrates a perspective view showing an adjustable ledger strap attached to the ledger stud and to a wall stud and showing the top side of a bathtub resting upon the top of the ledger stud with the rim of the bathtub adjacent to the wall stud.

FIG. 1 illustrates a front elevational view of adjustable ledger strap 10 of this invention which is a generally elongated planar strip of metal measuring approximately 10½ inches high and 1⅜ inches wide and which in a preferred embodiment can be made of 18 gauge galvanized sheet metal with die cut slots and apertures, as described below. Ledger strap 10 consists of three portions: an upper portion 60 being approximately 3 inches in height referred to as top lift tab 26, a mid portion 62 being approximately 5 inches in height, and a lower portion 64 being approximately 2 inches in height referred to as lower ledger stud support 24. A plurality of upper perforations 16 disposed in a row separate the top lift tab 26 from mid portion 62 and a plurality of lower perforations 18 disposed in a row separate the lower ledger stud support 24 from mid portion 62. Upper perforations 16 are wider than lower perforations 18. In use, prior to using the ledger straps of this invention, one first marks the positioning of at least two and preferably three wall studs along the length of the ledger stud 32 to be used, choosing a wall stud 30, as seen in FIG. 3, near each end of the ledger stud and preferably also one near its midpoint. One then takes each ledger strap and bends lower ledger stud support 24 along lower perforations 18 upward approximately 90 degrees so that each ledger strap forms an L shape. Then, as seen in the perspective view of FIG. 3, one attaches lower ledger stud support 24 to the bottom of ledger stud 32 by utilizing bottom strap engagement screws 36 which pass through bottom ledger strap engagement apertures 22 formed in ledger strap 10 and driven into the bottom of ledger stud 32. One also drives screws, not shown, through side ledger stud engagement apertures 20 defined in mid portion 62 into the rear of ledger stud 32. In this way ledger strap 10 is attached to ledger stud 32 with each ledger strap 10 being positioned, respectively, in front of its selected wall stud. One then screws pan head screw 28 into tightening screw slot 12 which is approximately 1½ inches long to retain ledger strap 10 temporarily in a position where ledger stud 32 is deemed to be close to its desired height. Then one can insert awl 34 or equivalent levering tool into either first lift slot 48, such as seen in FIGS. 2 and 4, or into second lift slot 58 where it can be used to lever ledger strap 10 upwards. Greater leverage is obtained using second lift slot 58, if needed. Also one can grasp top lift tab 26 to manually move ledger strap 10 up or down by lifting up or pushing down on top lift tab 26 until ledger stud 32 is at a desired height, as seen in FIG. 3. Once ledger stud 32 is at its desired height, then wood screws, such as wood screw 46, as seen in FIG. 5, can be driven through first, second, third and fourth attachment screw apertures 50, 54, 52 and 56 to permanently retain the ledger strap in its desired position on wall stud 30. One then removes protruding pan head screw 28 and also manipulates top lift tab 26 by bending it up and down until it breaks off along upper perforations 16, as seen in FIG. 5. Drywall can then be placed flush over each ledger strap 10 when they are permanently affixed in the desired position on their respective wall studs. Because each upper perforation 16 is elongated horizontally with little metal between each upper perforation, top lift tab 26 breaks off easily when bent up and down repeatedly. One can then continue to install the bathtub with its rim resting on top of the ledger stud by screwing in a tub attachment screw 66 driven into rim 68 of the bathtub, through tub attachment slot 14 and into wall stud 30 therebehind and then build the walls around the bathtub.

By using the mounting system of this invention, one can level the height of the bathtub after the tub's installation without the need for shims. The present invention also eliminates the necessity of having to remove a bathtub after installation should the bathtub ledger stud not be at the proper height since further adjustment is possible. Thus, height adjustment and leveling of the ledger stud are easy to accomplish from the front of the bathtub as opposed to having to climb into areas to reach behind the bathtub or from the side of the bathtub to adjust difficult-to-reach leveling screws as often required utilizing prior art devices. The present invention allows the bathtub to be positioned absolutely level from front to back and end to end quickly and efficiently so that wall construction and tile work can be accomplished quickly and accurately as one is starting with a level bathtub. In some instances the bathtub can also be biased to allow the fitting of bathtub surrounds where walls are not at right angles which type of installation is especially advantageous in older buildings.

Although the present invention has been described with reference to particular embodiments, it will be apparent to those skilled in the art that variations and modifications can be substituted therefor without departing from the principles and spirit of the invention.

We claim:

1. A device for leveling and supporting a bathtub on a horizontally disposed ledger stud, said ledger stud having a bottom planar surface and a rear planar surface, such bathtub of the type having an upwardly extending rim, comprising:

an elongated, vertically disposed ledger strap having a top and a bottom defining a length therebetween, a center defined along said length, a width, a front face and a rear face, said ledger strap having three portions defined on its front face from top to bottom being a top lift tab, a mid portion and a lower ledger stud support;

a plurality of upper perforations defined in said ledger strap separating said top lift tab from said mid portion, said upper perforations disposed perpendicular to said length of said ledger strap;

a plurality of lower perforations defined in said ledger strap separating said mid portion from said lower ledger stud support, said lower perforations disposed perpendicular to said length of said ledger strap;

at least one lift slot defined within said top lift tab;

an elongated tub attachment slot defined within said mid-portion, said tub attachment slot extending parallel to said length of said ledger strap;

an elongated tightening screw slot having first and second sides, a top and a bottom, said tightening screw slot defined in said ledger strap within said midportion and disposed above said tub attachment slot;

at least one attachment aperture defined in said mid portion below said upper perforations and disposed near said tightening screw slot;

attachment means for retaining said ledger strap to said ledger stud, said lower ledger stud support being bent upwards along said lower perforations towards said front face of said ledger strap at approximately a 90 degree angle, said front face of said lower ledger stud support positioned against said bottom planar surface of said ledger stud and with said rear planar surface of said ledger stud positioned against said front face of said mid portion of said ledger strap, said ledger strap attached by said attachment means to said ledger stud;

said top lift tab being bent downwards at approximately 30 degree angle toward said front face of said ledger strap along said upper perforations, said top lift tab for grasping and manually adjusting the height of said ledger stud after said ledger strap is releasably retained to said wall stud;

a screw passing through said tightening screw slot into said wall stud, said screw retaining said ledger stud at a desired height and level;

at least one attachment screw for passing through said at least one attachment aperture for attaching said ledger strap to said wall stud when said ledger stud is at said desired height and level; and said screw in said tightening screw slot being removable after said at least one attachment screw is engaged through said at least one attachment aperture and into said wall stud and said top lift tab adapted to be being broken away along said upper perforations.

2. The ledger strap of claim 1 wherein the height of said ledger stud on said wall stud can be manually adjusted by manually engaging an awl through said at least one lift slot and into said wall stud and using said awl as a lever to lift or lower, as desired, said ledger strap when said ledger strap is releasably retained to said wall stud by said screw in said tightening screw slot.

3. The ledger strap of claim 2 further including a tub attachment screw for passing through said rim of said bathtub, through said tub attachment slot and into said wall stud for retaining said bath tub rim to said wall stud when said bath tub is resting on said ledger stud at its desired height and level.

4. A device for leveling and supporting a bathtub on a horizontally disposed ledger stud, said ledger stud having a bottom planar surface and a rear planar surface, such bathtub of the type having an upwardly extending rim, comprising:

an elongated, vertically disposed ledger strap having a top and a bottom defining a length therebetween, a center defined along said length, a width, a front face and a rear face, said ledger strap having three portions defined on its front face from top to bottom being a top lift tab, a mid portion and a lower ledger stud support;

a plurality of upper perforations defined in said ledger strap separating said top lift tab from said mid portion, said upper perforations disposed perpendicular to said length of said ledger strap;

a plurality of lower perforations defined in said ledger strap separating said mid portion from said lower ledger stud support, said lower perforations disposed perpendicular to said length of said ledger strap;

first and second lift slots defined within said top lift tab, said first and second lift slots disposed one above the other along said center of said length of said ledger strap, said first and second lift slots disposed extending parallel to said length of said ledger strap;

an elongated tub attachment slot defined along said center of said length of said ledger strap within said midportion, said tub attachment slot extending parallel to said length of said ledger strap;

an elongated tightening screw slot having first and second sides, a top and a bottom, said tightening screw slot defined along said center of said length of said ledger strap within said midportion and disposed above said tub attachment slot, said tightening screw slot extending parallel to said length of said ledger strap;

first, second, third and fourth attachment apertures defined in said mid portion below said upper perforations, said first and second attachment apertures disposed, respectively, near said first and second sides of said tightening screw slot near said top of said tightening screw slot; and said third and fourth attachment apertures disposed, respectively, near said first and second sides of said tightening screw slot near said bottom of said tightening screw slot;

first and second side ledger stud engagement apertures defined in said mid portion below said tub attachment slot and above said lower perforations;

first and second bottom ledger stud engagement apertures defined in said lower ledger stud support below said lower perforations, said first and second bottom ledger stud engagement apertures defined, respectively, on opposite sides of said center of said ledger strap, said lower ledger stud support being bent upwards along said lower perforations toward said front face of said ledger strap at approximately a 90 degree angle, said front face of said lower ledger stud support positioned against said bottom planar surface of said ledger stud and with said rear planar surface of said ledger stud positioned against said front face of said mid portion of said ledger strap, said ledger strap for attachment to said ledger stud by screws passing through said first and second side ledger stud engagement apertures and through said first and second bottom ledger stud engagement apertures into said ledger stud;

said top lift tab being bent downwards at approximately 30 degree angle toward said front face of said ledger strap along said upper perforations, said top lift tab for grasping and manually adjusting the height of said ledger stud after said ledger strap is releasably retained to said wall stud;

a screw passing through said tightening screw slot into said wall stud, said screw retaining said ledger stud at a desired height and level;

first, second, third and fourth attachment screws for passing, respectively, through said first, second, third and fourth attachment apertures for attaching said ledger strap to said wall stud when said ledger stud is at the desired height and level; and said screw in said tightening screw slot being removable after said first, second, third and fourth attachment screws are engaged through said first, second and third attachment apertures and into said wall stud and said top lift tab adapted to be broken away along said upper perforations.

5. The ledger strap of claim 4 wherein the height of said ledger stud on said wall stud can be manually adjusted by manually engaging an awl through a selected one of said first and second lift slots and into said wall stud and using said awl as a lever to lift or lower, as desired, said ledger strap when said ledger strap is releasably retained to said wall stud by said screw in said tightening screw slot.

6. The ledger strap of claim 5 further including a tub attachment screw for passing through said rim of said bathtub, through said tub attachment slot and into said wall stud for retaining said bath tub rim to said wall stud when said bath tub is resting on said ledger stud at its desired height and level.

7. A method for leveling and supporting a bathtub on a horizontally disposed ledger stud, said ledger stud having a bottom planar surface and a rear planar surface, such bathtub of the type having an upwardly extending rim, comprising the steps of:

providing an elongated, vertically disposed ledger strap having a top and a bottom defining a length therebetween, a center defined along said length, a width, a front face and a rear face, said ledger strap having three portions defined on its front face from top to bottom being a top lift tab, a mid portion and a lower ledger stud support, said ledger strap having:

a plurality of upper perforations defined in said ledger strap separating said top lift tab from said mid portion, said upper perforations disposed perpendicular to said length of said ledger strap;

a plurality of lower perforations defined in said ledger strap separating said mid portion from said lower ledger stud support, said lower perforations disposed perpendicular to said length of said ledger strap;

at least one lift slot defined within said top lift tab;

an elongated tub attachment slot defined within said mid portion, said tub attachment slot extending parallel to said length of said ledger strap;

an elongated tightening screw slot having first and second sides, a top and a bottom, said tightening screw slot defined in said ledger strap within said midportion and disposed above said tub attachment slot;

at least one attachment aperture defined in said mid portion below said upper perforations near said tightening screw slot;

at least one side ledger stud engagement aperture defined in said mid portion below said tub attachment slot and above said lower perforations;

at least one bottom ledger stud engagement aperture defined in said lower ledger stud support below said lower perforations;

bending said lower ledger stud support upwards along said lower perforations towards said front face of said ledger strap at approximately a 90 degree angle;

positioning said front face of said lower ledger stud support against said bottom planar surface of said ledger stud;

positioning said front face of said mid portion of said ledger strap against said rear planar surface of said ledger stud;

attaching said ledger strap to said ledger stud by screws passing through said at least one side ledger stud engagement aperture and through said at least one bottom ledger stud engagement aperture into said ledger stud;

bending said top lift tab downwards at approximately 30 degree angle toward said front face of said ledger strap along said upper perforations;

grasping and manually adjusting the height of said ledger stud after said ledger strap is releasably retained to said wall stud;

providing a screw;

passing said screw through said tightening screw slot into said wall stud;

retaining said ledger stud at a desired height and level;

providing at least one attachment screw;

attaching said ledger strap to said wall stud by passing said at least one attachment screw through said at least one attachment screw aperture when said ledger stud is at the desired height and level; and removing said screw in said tightening screw slot after said at least one attachment screw is engaged through said at least one attachment aperture and into said wall stud; and breaking away said top lift tab from said ledger strap along said upper perforations.

8. The method of claim 7 further including the steps of:

providing an awl;

engaging said awl through said at least one lift slot and into said wall stud; and using said awl as a lever to lift or lower, as desired, said ledger strap.

9. The method of claim 8 further including the steps of:

providing a tub attachment screw;

screwing said tub attachment screw through said rim of said bathtub and through said tub attachment slot and into said wall stud; and retaining said bath tub to said wall stud at its desired height.

10. A method for leveling and supporting a bathtub on a horizontally disposed ledger stud, said ledger stud having a bottom planar surface and a rear planar surface, such bathtub of the type having an upwardly extending rim, comprising the steps of:

providing an elongated, vertically disposed ledger strap having a top and a bottom defining a length therebetween, a center defined along said length, a width, a front face and a rear face, said ledger strap having three portions defined on its front face from top to bottom being a top lift tab, a mid portion and a lower ledger stud support, said ledger strap having:

a plurality of upper perforations defined in said ledger strap separating said top lift tab from said mid portion, said upper perforations disposed perpendicular to said length of said ledger strap;

a plurality of lower perforations defined in said ledger strap separating said mid portion from said lower ledger stud support, said lower perforations disposed perpendicular to said length of said ledger strap;

first and second lift slots defined within said top lift tab, said first and second lift slots disposed one above the other along said center of said length of said planar member, said first and second lift slots disposed extending parallel to said length of said planar member;

an elongated tub attachment slot defined along said center of said length of said ledger strap within said midportion, said tub attachment slot extending parallel to said length of said ledger strap;

an elongated tightening screw slot having first and second sides, a top and a bottom, said tightening screw slot defined along said center of said length of said ledger strap within said midportion and disposed above said tub attachment slot, said tightening screw slot extending parallel to said length of said ledger strap;

first, second, third and fourth attachment apertures defined in said mid portion below said upper perforations, said first and second attachment apertures disposed, respectively, near said first and second sides of said tightening screw slot near said top of said tightening screw slot; and said third and fourth attachment apertures disposed, respectively, near said first and second sides of said tightening screw slot near said bottom of said tightening screw slot;

first and second side ledger stud engagement apertures defined in said mid portion below said tub attachment slot and above said lower perforations;

first and second bottom ledger stud engagement apertures defined in said lower ledger stud support below said lower perforations, said first and second bottom ledger stud engagement apertures defined, respectively, on opposite sides of said center of said ledger strap;

bending said lower ledger stud support upwards along said lower perforations towards said front face of said ledger strap at approximately a 90 degree angle;

positioning said front face of said lower ledger stud support against said bottom planar surface of said ledger stud;

positioning said front face of said mid portion of said ledger strap against said rear planar surface of said ledger stud;

providing first and second side ledger stud engagement screws;

attaching said ledger strap to said ledger stud by said first and second side ledger stud engagement screws passing through said first and second side ledger stud engagement apertures and through said first and second bottom ledger stud engagement apertures into said ledger stud;

bending said top lift tab downwards at approximately 30 degree angle toward said front face of said ledger strap along said upper perforations;

grasping and manually adjusting the height of said ledger stud after said ledger strap is releasably retained to said wall stud;

providing a tightening screw;

passing said tightening screw through said tightening screw slot into said wall stud;

retaining said ledger stud at a desired height and level;

providing first, second, third and fourth attachment screws;

screwing said first, second, third and fourth attachment screws, respectively, through said first, second, third and fourth attachment apertures in said ledger strap and into said wall stud when said ledger stud is at the desired height and level; and removing said tightening screw in said tightening screw slot; and breaking away said top lift tab along said upper perforations.

11. The method of claim 10 further including the steps of:

providing an awl;

engaging said awl through a selected one of said first and second lift slots and into said wall stud; and using said awl as a lever to lift or lower, as desired, said ledger strap.

12. The method of claim 11 further including the steps of:

providing a tub attachment screw;

screwing said tub attachment screw through said rim of said bathtub and through said tub attachment slot and into said wall stud; and retaining said bath tub to said wall stud at its desired height.

* * * * *